US007975748B2

(12) United States Patent
Yu et al.

(10) Patent No.: US 7,975,748 B2
(45) Date of Patent: Jul. 12, 2011

(54) SUSPENSION SYSTEM FOR A CORDLESS WINDOW COVERING

(75) Inventors: Fu-Lai Yu, Taipei Hsieh (TW); Chin-Tien Huang, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 567 days.

(21) Appl. No.: 11/591,718

(22) Filed: Nov. 2, 2006

(65) Prior Publication Data

US 2008/0128097 A1 Jun. 5, 2008

(51) Int. Cl.
*E06B 3/322* (2006.01)

(52) U.S. Cl. ..... 160/84.05; 160/170

(58) Field of Classification Search ..... 160/170, 160/171, 84.04, 84.05, 168.1 R
See application file for complete search history.

(56) References Cited

U.S. PATENT DOCUMENTS

| | | | | |
|---|---|---|---|---|
| 2,276,716 | A * | 3/1942 | Cardona | 160/170 |
| 4,372,432 | A | 2/1983 | Waine et al. | |
| 4,433,765 | A | 2/1984 | Rude et al. | |
| 4,623,012 | A | 11/1986 | Rude et al. | |
| 4,697,630 | A | 10/1987 | Rude et al. | |
| 5,482,100 | A | 1/1996 | Kuhar | |
| 5,531,257 | A | 7/1996 | Kuhar | |
| 5,793,174 | A | 8/1998 | Kovach | |
| 5,964,427 | A | 10/1999 | Aiston | |
| 5,990,646 | A | 11/1999 | Kovach et al. | |
| 6,012,506 | A * | 1/2000 | Wang et al. | 160/170 |
| 6,024,154 | A | 2/2000 | Wang et al. | |
| 6,029,734 | A | 2/2000 | Wang et al. | |
| 6,056,036 | A | 5/2000 | Todd et al. | |
| 6,057,658 | A | 5/2000 | Kovach et al. | |
| 6,079,471 | A | 6/2000 | Kuhar | |
| 6,181,089 | B1 | 1/2001 | Kovach et al. | |
| 6,234,236 | B1 | 5/2001 | Kuhar | |
| 6,259,218 | B1 | 7/2001 | Kovach et al. | |
| 6,289,965 | B1 | 9/2001 | Ruggles | |
| 6,330,899 | B1 | 12/2001 | Ciuca et al. | |
| 6,369,530 | B2 | 4/2002 | Kovach et al. | |
| 6,474,394 | B2 | 11/2002 | Kuhar | |
| 6,571,853 | B1 | 6/2003 | Ciuca et al. | |
| 6,575,223 | B1 | 6/2003 | Chung et al. | |
| 6,601,635 | B2 | 8/2003 | Ciuca et al. | |
| 6,644,372 | B2 | 11/2003 | Judkins | |
| 6,644,373 | B2 | 11/2003 | Palmer | |
| 6,644,374 | B2 | 11/2003 | Nien | |
| 6,644,375 | B2 | 11/2003 | Palmer | |
| 6,662,850 | B2 | 12/2003 | Chung et al. | |
| 6,684,930 | B2 | 2/2004 | Palmer et al. | |
| 6,691,760 | B1 | 2/2004 | Randall, Jr. et al. | |
| 6,725,897 | B2 | 4/2004 | Palmer | |
| 6,823,925 | B2 | 11/2004 | Militello et al. | |
| 2002/0157796 | A1 | 10/2002 | Judkins | |
| 2004/0007333 | A1 * | 1/2004 | Militello et al. | 160/84.04 |
| 2004/0094274 | A1 | 5/2004 | Judkins | |
| 2004/0177933 | A1 | 9/2004 | Hillman et al. | |

* cited by examiner

*Primary Examiner* — David Purol
(74) *Attorney, Agent, or Firm* — Olson & Cepuritis, Ltd.

(57) ABSTRACT

A suspension system for a window covering that eliminates the use of pull cords is provided. The suspension system includes a control module having a winding drum and a spring disposed about an axle. A friction member or reaction member is also provided to offset difference in the force exerted by the spring on a suspension cord versus the weight of the window covering member.

27 Claims, 4 Drawing Sheets

SUSPENSION SYSTEM FOR A CORDLESS WINDOW COVERING

TECHNICAL FIELD OF THE INVENTION

This invention relates to suspension system for a window covering. The suspension system provides a mechanism for control of the window covering without use of a pull cord.

BACKGROUND OF THE INVENTION

Window coverings, such as honeycomb window shades, Venetian blinds, and Roman shades typically have a head rail and a window cover material, such as pleated fabric, a plurality of slats, or blind members, which are controlled by cords, whereby a pull cord coupled to the slats, blind members, or fabric can be adjusted to raise or open the window covering. The pull cord extends from a headrail and is manipulated by a user to adjust the position of suspension cords and to thereby adjust the position of the window cover material. One shortcoming of such pull cords is that they require peripheral members that distract from the window cover material and can lessen the aesthetic appearance of the window covering. In addition, pull cords also present a potentially dangerous situation in that they are of relatively long lengths and may be mishandled by certain persons, especially children, such that accidental choking or hanging may occur.

There have been various developments in window coverings that do not utilize a lifting cord with a cord lock. One such patent is U.S. Pat. No. 2,420,301, issued May 13, 1947 to Cusumano for "Venetian Blind" which utilizes a cone-shaped member with grooves and a coil spring. This window covering design includes a counterbalance to enable positioning of the blind slats as desired without a lock. Another attempt includes U.S. Pat. No. 2,324,536 issued to Pratt and titled "Closure Structure" and utilizes tapes and coil springs to raise and lower a blind in which the bottom bar and the slats ride in tracks as they move upwardly and downwardly.

One issue that has been presented in other so-called cordless window coverings is that as a window covering is raised, increasing amounts of the window cover material are gathered and supported on the bottom rail, thereby increasing the weight suspended by the suspension cord. One patent directed to addressing this problem is U.S. Pat. No. 5,133,399, issued to Hiller et al. and titled "Apparatus by Which Horizontal and Vertical Blinds, Pleated Shades, Drapes and the Like May Be Balanced for No Load Operation." In this device, a variable, upwardly directed force is applied to the cord structure with the force being substantially equivalent at all times to the combined weights of the lower rail and the blind members supported on the lower rail when the lower rail is above its lowermost operative position. The apparatus for applying the force includes a conical member coupled to a constant force spring or a variable force leaf spring. Other patents include U.S. Pat. No. 5,482,100, issued to Kuhar and titled "Cordless, Balanced Venetian Blind or Shade with Consistent Variable Force Spring Motor."

In one version, a variable force spring is wound on drums whereby spring force imparted to a coiled spring is transferred from one drum to another. With these variable force spring motors, the force exerted is at its greatest when the blind or shade is fully raised such that the cords are supporting most or all of the weight for the bottom rail and the window cover material. The spring force is at its lowest point when the window covering is fully lowered such that only the bottom rail is supported by the suspension cord. In another embodiment, a constant force spring is utilized with a friction imparting device to accommodate the variable weight of the window covering between the raised and lowered positions.

One shortcoming of the previous attempts, however, is the complexity of the designs in that a substantial number of interconnected parts are required. The present invention provides a cordless window covering and does so in a more efficient manner.

SUMMARY OF THE INVENTION

The present invention is directed to a window covering that does not require the use of pull cords. In a preferred embodiment, the present invention includes a window covering suspension system that includes a head rail, at least one suspension cord, a control module and a friction member or reaction member. The suspension system can be combined with a window cover member that includes a window cover material and a weighted element, such as a bottom rail, to form the window covering.

The head rail preferably includes a transverse channel. A rotary axle is disposed within the channel and defines a longitudinal axis. At least one control module is positioned in the channel and the rotary axle extends through the control module. Preferably, more than one control module is positioned about the axle so that they operate together to evenly open and close the window covering.

The control module includes a support structure, such as a housing, into which a rotary winding drum and a spring are positioned and supported by the support structure. The spring is preferably a constant force flat spiral spring. The winding drum and spring are operatively connected to one another such that the spring exerts a rotational force on the winding drum. Preferably, the winding drum and spring are connected by a rotary spindle, and each of the winding drum, rotary spindle, and spring are positioned about the rotary axle. These components of the control module may be coaxial with one another. A friction member or reaction member is also provided for reasons discussed in further detail below.

A first end of the suspension cord is connected to the winding drum such that as the winding drum is rotated by the rotational force provided by the spring, the suspension cord is wound thereon. As discussed, the spring is preferably a constant force spring that provides a substantially constant amount of torque throughout the range of extension for the spring. Suitable constant force springs are known in the art. With such springs, the force exerted by the spring to resist uncoiling is constant since the change in the radius of curvature is constant.

A second end of the suspension cord is connected to weighted element, e.g., a bottom rail of the window cover member, such that as the suspension cord is wound on the winding drum, the bottom rail is raised and window cover material is gathered on the bottom rail. The suspension cord travels a path that engages the friction member or reaction member, such as a hook that may take the form of a standard hook, and eyelet, horseshoe-shaped member, unshaped member, or other piece through which the suspension cord may pass. The support structure may also be configured to form the friction member or reaction member by offsetting surfaces formed within the support structure such that the suspension cord is caused to travel a path including a plurality of turns, and preferably at least three turns, thereby increasing the force required to overcome the static friction force on the cord. Similarly, by including a plurality of turns, the reaction force on the cord by the reaction member is increased. The suspension system may also include a combination of such friction members or reaction members.

In use, the spring is configured to exert a rotational force on the winding drum. The rotational force is translated by the winding drum to an upward force on a portion of the suspension cord as the window covering is moved between a lowered position and a raised position. For example, as the cord is wound on the winding drum, the tangential force of the winding drum is the upward force on the cord. At the same time, the suspension cord supports the weight of the window cover material and bottom rail. As discussed, the total weight supported by the cord increases as the window covering is raised from a lowered position to a raised position due to the increasing amount of window cover material supported by the bottom rail. The amount of cord also contributes to the overall weight, but only to a relatively small degree. An additional force opposite the gravitational force may come from the window cover material itself in that the material, such as found in a honeycomb or cellular shade, may possess an inherent spring force. For example, a honeycomb or cellular window cover material, when stretched, will tend to retract as a result of memory in the material.

The friction member provides a static friction force to the cord and is configured to provide sufficient static friction such that the difference between the weight of the window cover member and cord versus the sum of the window cover material spring force and the spring upward force are offset, thereby maintaining a desired position for the window covering. In other words, when the window covering is stationary or not being adjusted, the static friction force offsets the net result of the other upward and downward forces on the suspension cord such that the window cover member is not unintentionally raised or lowered. This friction member engages the cord, and is preferably positioned downstream of the winding drum. In other words, the friction member is positioned to engage a portion of the cord that is not wound on the winding drum.

The amount of friction can be adjusted depending on the weight of the window cover member and the cord texture and thickness by configuring the friction member, such as the hook member, to cause the suspension member to travel a path that includes a plurality of turns. The distances between turns, the angles of the turns, and the amount of contact between the friction member and the cord can all be adjusted to provide the desired amount of static friction suitable for a particular application. A higher static friction allows the same control module to be used over a greater range of window covering lengths.

The hook may also be a reaction member designed to prevent undesired movement of the bottom rail and ensure a stationary position (e.g., no movement between the cord and the hook). A reaction force exerted by the hook on the cord, or other offset surfaces, contributes to counteract the force of the spring to keep stationary the cord when the bottom rail is positioned at the desired height.

As discussed, however, the winding drum and spring in the control module are preferably in a coaxial relationship with one another and are engaged with the axle which is guided through the winding drum and spring. In this manner, multiple similarly configured control modules may be utilized to accommodate different weight window cover members and different size window coverings. Such modularity provides substantial advantages over the prior art.

A clutch mechanism may also be included in the suspension system to provide even greater flexibility in design. Clutch mechanisms, such as utilized in roller shades are generally known, and are designed to engage a rotating axle to releasably lock the axle. With the present invention, a clutch mechanism may be employed along with the control module.

DESCRIPTION OF THE PREFERRED EMBODIMENTS OF THE INVENTION

Figure 1:
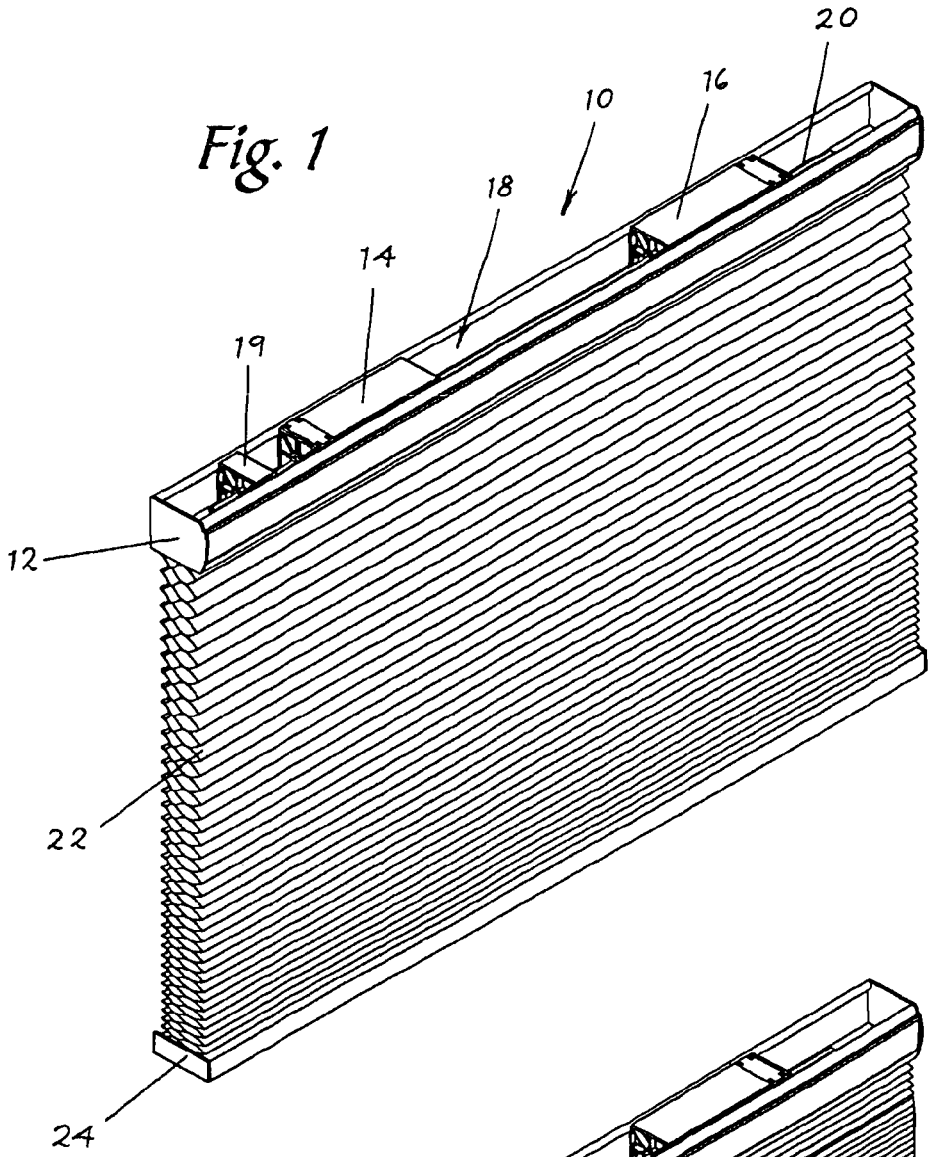
FIG. 1 is a perspective view of a preferred embodiment of the present invention with a window covering in a lowered position.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Referring to FIG. 1, a preferred embodiment of the present invention is shown. Window covering 10 includes a head rail 12, a pair of control modules 14, 16 positioned within a channel 18 of the head rail 12 about axle 20. A window cover member is also provided comprising window cover material 22 and weighted element, such as bottom rail 24. As shown, the window covering 10 is in a lowered position such that the window cover material 22 is extended to cover a window space. In this particular embodiment, the window cover material 22 is shown as a double cell cellular material, however, other materials may also be used including honeycomb materials, Venetian blinds, Roman shades, Roman style shades, or the like. Also shown in this embodiment in engagement with the axle 20 is a clutch mechanism 19. Any clutch mechanism as is known in the art may be utilized. For example, clutch mechanism 19 may be configured such that it locks the axle when engaged. By pulling down on bottom rail 24 slightly, the clutch member is disengaged from the axle to permit rotation of the axle 20. When the window covering is in the desired position, the bottom rail 24 is again pulled down slightly to engage the clutch mechanism 19.

Figure 2:
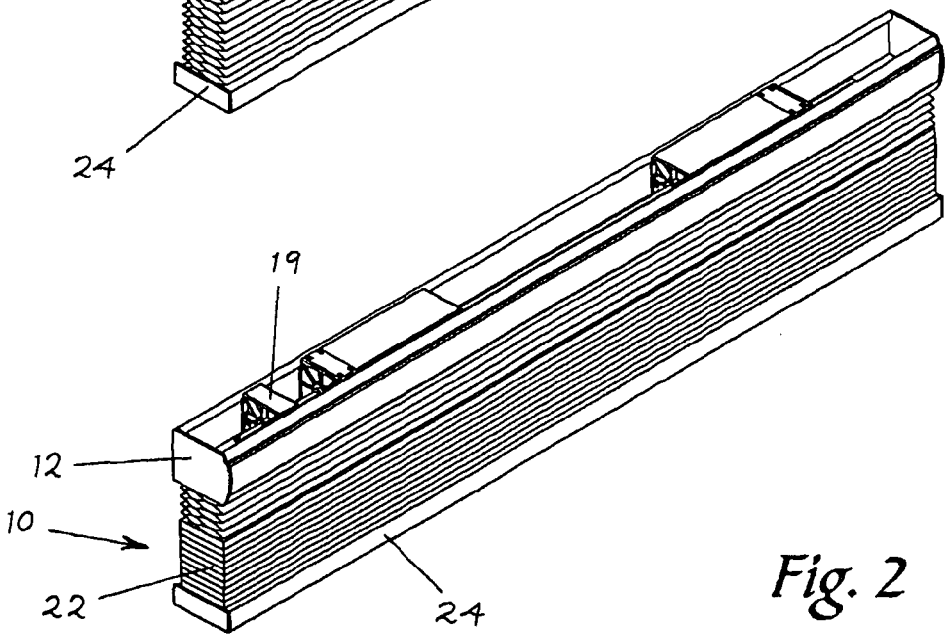
FIG. 2 is a perspective view of the embodiment of FIG. 1 with the window covering in a partially raised position.
Figure 3:
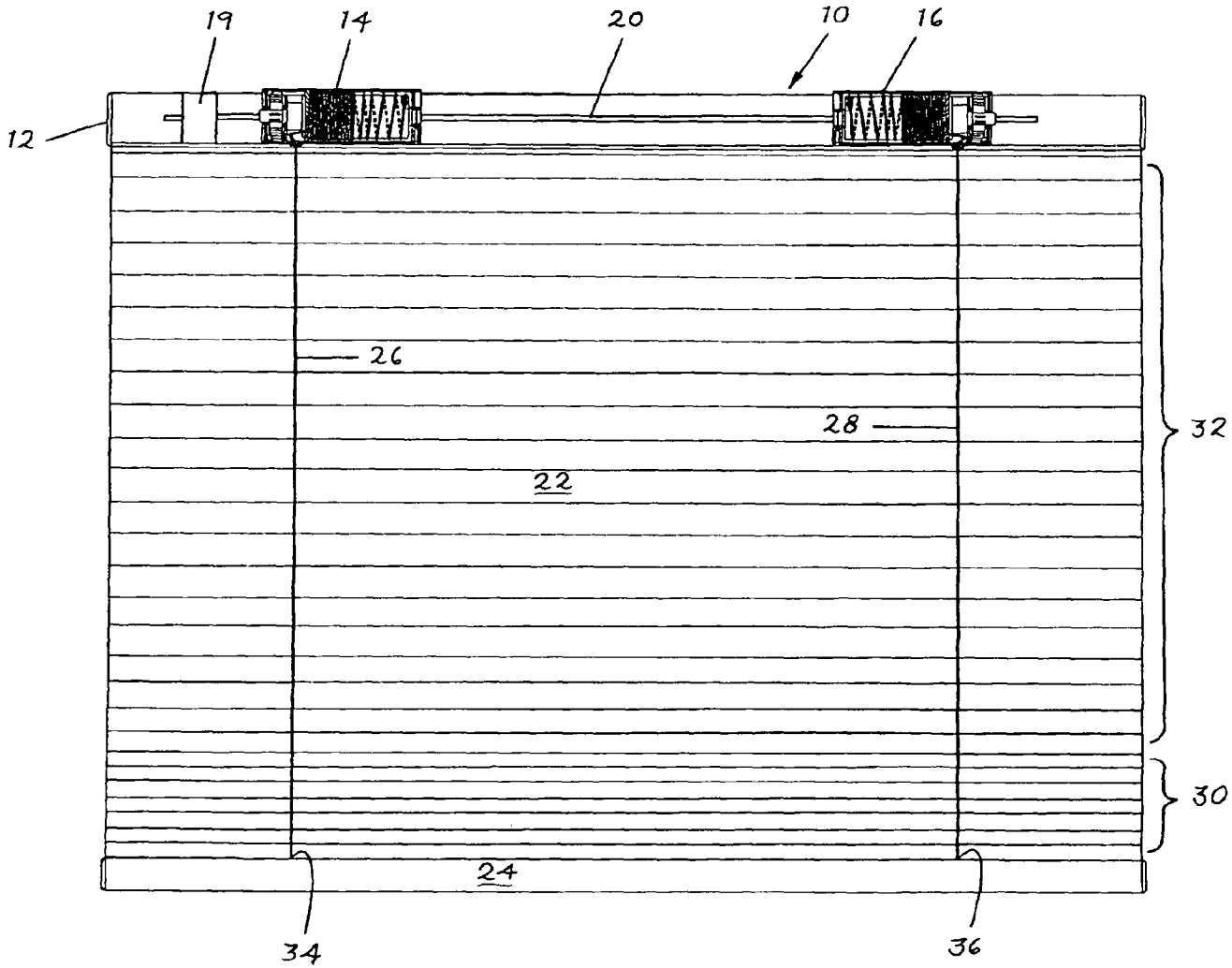
FIG. 3 is a front view of a preferred embodiment of the present invention in a partially raised position with the head rail and housing of the control module cut away and suspension cords shown in phantom.

Shown in FIG. 2 is the window covering 10 of FIG. 1 in a partially raised position. As the window covering 10 is raised, window cover material 22 is gathered and supported by bottom rail 24. This is more clearly shown in FIG. 3. Suspension cords 26, 28 extend from control modules 14, 16, respectively, pass through window cover material 22, and are connected with bottom rail 24. In this preferred embodiment, the suspension cords 26, 28 are connected directly to bottom rail 24, however, other methods of operatively connecting the bottom rail to the suspension cords may also be utilized. For example, fastener modules may be used to enable the bottom rail to be easily replaced. In certain applications, a panel of material may be combined with a bottom rail such that the suspension cords are connected to the bottom rail by way of attachment to a connected panel of material. While the weighted element has been described thus far as a bottom rail, it is not limited to a straight elongated structure; instead, any weighted member can be utilized. Also, while two control modules 14, 16 are shown engaged with axle 20, it should be understood that any number of control modules can be used.

As the window covering 10 is moved from a lowered position to a raised position, the suspension cords 26, 28 are wound within control modules 14, 16 in a manner described in greater detail below. As the bottom rail 24 is brought closer to head rail 12, window cover material 22 is gathered and supported by the bottom rail 24. As shown, a gathered portion 30 of window cover material 22 is resting on the bottom rail, such that the weight of gathered portion 30 plus the bottom rail 24 are supported by the suspension cords 26, 28. The ungathered portion 32 of the window cover material 22 is suspended from head rail 12 and is not supported by the suspension cords 26, 28. As should be readily understood, the weight, supported by the suspension cords 26, 28 increases as the window covering 10 is moved to a raised position. In other words, the weight on the ends 34 and 36 of suspension cords 26, 28 increases as more window cover material 22 is gathered and supported by the bottom rail 24. Although not shown, in the context of a Venetian blind, the number of slats that would be supported by the suspension cords, as opposed to ladder cords, would increase as the Venetian blind is raised.

In this particular embodiment, two control modules 14, 16 are mounted about axle 20. As discussed, the number of modules in a particular window covering can vary as needed. Due to the modular nature of the control modules and the common axle, stock quantities of the control modules can be utilized rather than require adjustment of individual control modules that increases manufacturing costs and complexity. Also, given the nature of window coverings as often being customized for a particular window, modular control modules provide greater flexibility in manufacturing. The use of a common axle to connect the plurality of control modules also provides for a simple and reliable means for synchronization and balancing of the control modules to promote even lifting of the window covering, unlike the prior art.

Figure 4:
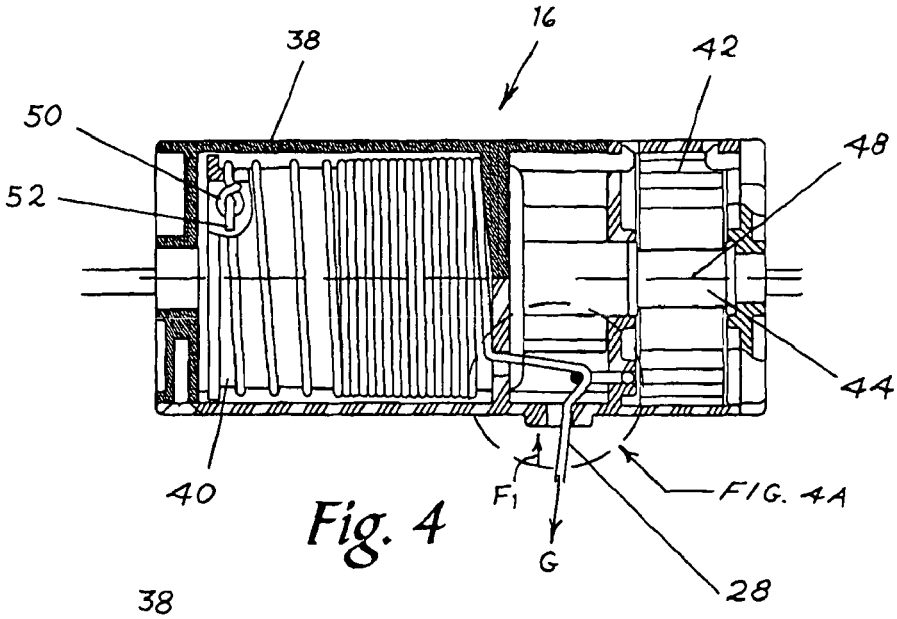
FIG. 4 is a side elevated view of a preferred control module of the present invention with portions shown in cross section.
Figure 5:
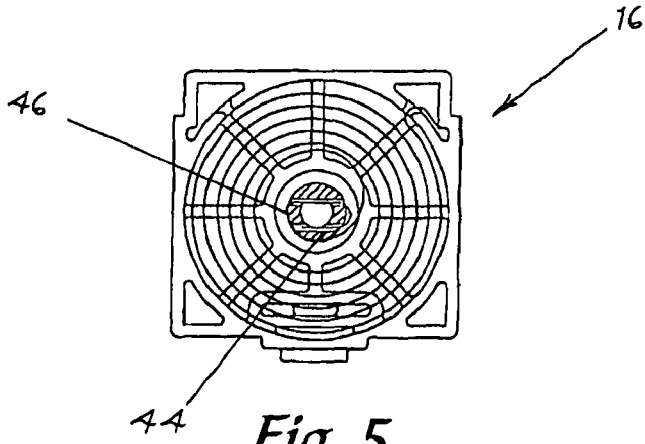
FIG. 5 is an end view of the control module of FIG. 4.
Figure 6:
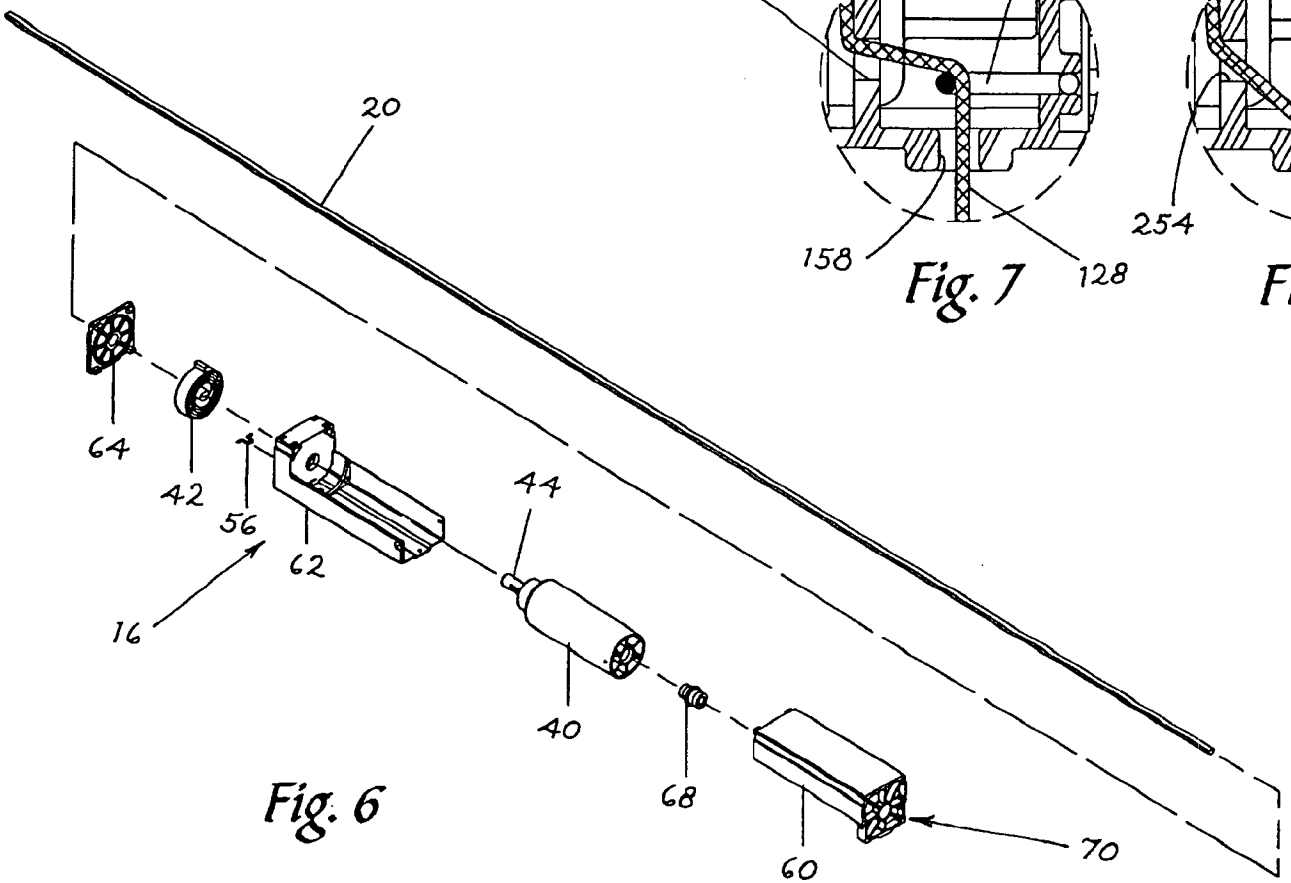
FIG. 6 is an exploded view of the control module of FIG. 4 and the axle.

Greater detail on the control modules is described with FIGS. 4-6. Referring to FIG. 4, control module 16 is shown. Control module 16 includes a support structure, such as housing 38. Positioned within housing 38 are a winding drum 40 and a spring 42 (shown in cross section). The winding drum 40 and spring 42 are operatively connected to one another such that the spring 42 exerts a rotational force, i.e., torque, on the winding drum 40. In this embodiment, the winding drum 40 and spring 42 are connected by a rotary spindle 44 that is integrally formed with the winding drum 40. Referring to FIG. 5, the spring 42 is secured at an end 46 to spindle 44. Preferably, spring 42 is a constant force spring that provides a constant amount of force or torque throughout the range of extension of the spring. Each of the winding drum 40, rotary spindle 44 and spring 42 are positioned about the rotary axle 20, which also defines a longitudinal axis 48. It is preferred that winding drum 40, rotary spindle 44 and spring 42 are coaxial with one another. The axle 20 inserts through the drum 40 and spindle 44 as the control module 16 is mounted on the axle 20. This simple assembly permits easy and flexible mount of many control modules for wider window covering requiring more suspension cords.

Figure 4A:
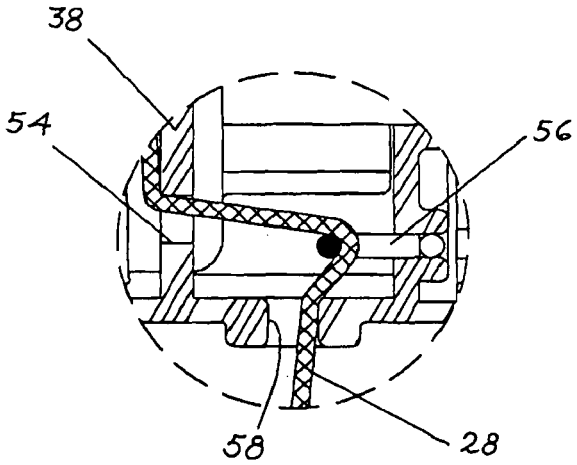
FIG. 4A is an enlarged view of the friction member of the control module of FIG. 4.

Referring again to FIG. 4, suspension cord 28 is secured at a first end 50 to a post 52 formed on winding drum 40. When window covering 10 (FIG. 3) is raised, the suspension cord 28 is wound on winding drum 40 rotated by the torque from spring 42. Referring to FIG. 4A, the suspension cord 28, in this embodiment, is passed through hole 54 formed in housing 38. Suspension cord then travels a path though hook 56, and then exits housing 38 through hole 58. As such, the suspension cord 28 travels a path including three turns between the winding drum 40 and the window cover member including window cover material 22 and bottom rail 24. The engagement with the housing 38 as the suspension cord 28 passes though holes 54 and 58, as well as the engagement with the hook 56 generate a static friction force on the suspension cord 28 that resists movement when the window covering 10 is stationary, i.e., not being adjusted. The housing 38 and the hook 56 also provide a reaction force on the suspension cord 28.

Referring again to FIG. 4, the spring 42 exerts a rotational force on winding drum 40 that, because the first end 50 of the suspension cord 28 is secured to winding drum 40, is translated to a force ($F_1$) on the suspension cord 28. Yet another force that is applied to suspension cord 28 when the window covering 10 is stationary is the weight (G) of the window cover material 22 the portion of the cord which is unwound, and the bottom rail 24. The amount of cord unwound from the winding drum 40 contributes to the overall weight to a relatively small degree while the bottom rail 24 preferably provides most of the weight (G). Also, as discussed, in some window coverings, the window cover material 22 itself may contribute a force $F_2$ (not shown) to the bottom rail 24 opposite to the force of gravity. This force $F_2$ is significantly smaller than the force $F_1$. In other words, the downward weight exerted on the suspension cord 28 is lighter for vertically lower positions of the bottom rail 24. In these configurations, the sustaining force exerted by the spring 42 may exceed the downward weight and adversely cause an upwardly biased displacement of the bottom rail 24.

In order to prevent the foregoing unintended movement, the friction member, which in this embodiment comprises the engagement locations with the housing 38 as the suspension cord passes through holes 54 and 58 and the hook 56, is put in contact with the cord to create the static friction force $F_{static}$ that suitably balances the difference between the opposing forces applied to the cord 28. The forces that tend to move the window cover 10 to a raised position applied to the suspension cord 28 include the force $F_1$ from the spring 42 and the spring force of the window cover material 22. Counterbalancing these raising forces are the downward forces G caused by the weight of the window cover material 22 and the bottom rail 24, and to a minor degree the unwound portion of the suspension cord 28. The total weight on the suspension cord 28 increases as the window covering 10 is raised from a lowered position to a raised position due to increasing amount of the window cover material 22 supported by the bottom rail 24.

In order to prevent unintended movement of the window covering 10, the friction member is positioned downstream of the winding drum, which in this embodiment comprises the engagement with the housing 38 as the suspension cord 28 passes though holes 54 and 58 and the engagement with the hook 56, creates a static friction force $F_{static}$ that is greater than or equal to the difference between the total gravitational force G and the sum of Force $F_1$ and $F_2$ regardless of the position of the window cover 10. In other words:

$F_{static} \geqq |G-(F_1+F_2)|$, where:

G is the weight of the window cover material, bottom rail, and unwound portion of the cord;

$F_1$ is the linear force exerted by the spring on the suspension cord;

$F_2$ is the spring force of the window cover material on bottom rail; and $F_{static}$ is the static friction force of the friction member.

The suitable amount of frictional force can be determined depending on factors such as the weight of the window cover member and the cord texture and thickness, bottom rail weight, and spring force of the window cover material. By adjusting one or more of these factors, a sufficient amount of static friction force for the suspension cord can be included in the present invention.

In order to raise window covering 10, a user exerts a force on the bottom rail opposite the force of gravity such that the static friction force $F_{static}$ is overcome. Sufficient force by the user must be exerted such that the difference between the total gravitational force G and the sum of Force $F_1$ and $F_2$ is overcome. Similarly, in order to lower the window covering 10, a user pulls down on the bottom rail so that the static friction force $F_{static}$ is overcome. As should be readily appreciated, this difference is intended to be such that only a moderate amount of force by the user is required.

One of the advantages of the present design is that the static friction is automatically adjusted to meet the needs of the window covering so it remains stationary. As the window covering is opened, the weight G on the cord increases and tends to make the window covering close. However, because the static friction force $F_{static}$ is a function of the tension on the cord as it acts against the friction member, the static friction increases to counteract the increase in weight.

The relevant forces in the present invention may also be viewed from the perspective of reaction forces, and the friction member may be considered as a reaction member. This reaction member exerts a reaction force against the suspension cord to prevent undesired movement of the bottom rail and ensure a stationary position. This counterforce applied to the cord is a reaction force because it counterbalances the force of the suspension cord against the various surfaces. When viewed it in this context, it should be understood that the reaction force is at most equal to the difference between force G and $F_1$ and $F_2$.

Referring to FIG. 6, a brief explanation of the various parts of the control module 16 is provided. The housing 38 includes a cover 60, a base 62 and an end cap 64. Hook 56 is also provided. Winding drum 40 is formed integrally with rotary spindle 44. A separate spindle 68 is also provided which is configured to connect winding drum 40 to end 70 of housing cover 60. Axle 20 is guided through control module 16.

Figure 8:
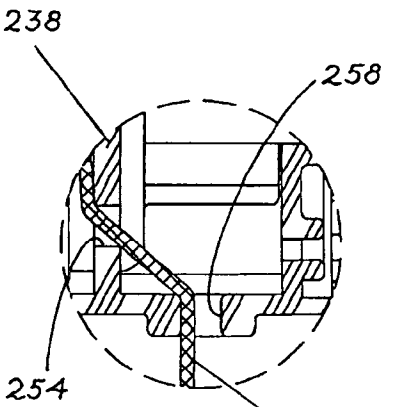
FIG. 8 is an enlarged view of another alternate preferred embodiment of a friction member.
Figure 7:
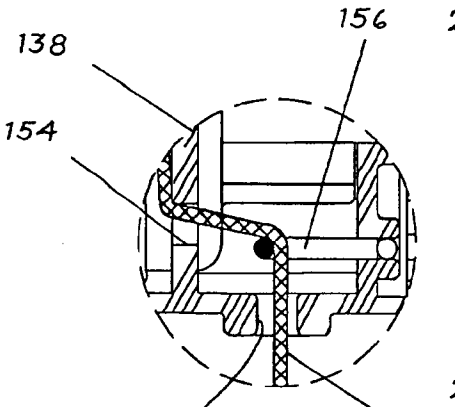
FIG. 7 is an enlarged view of an alternate preferred embodiment of a friction member.

Referring to FIGS. 7 and 8, alternate embodiments of a friction member are shown. In FIG. 7, the suspension member 128 exits though hole 154 formed in housing 138. The suspension cord also engages hook 156 extending over the hole 158. Unlike the previous embodiment, however, the suspension member 128 does not engage hole 158. As such, in this embodiment, the cord travels along a path having two turns. In FIG. 8, no hook member is included. In this embodiment, the suspension cord 228 interacts with the rims of the holes 254 and 258 through which it travels.

The descriptions above have shown the control modules as being located in the head rail. Is some embodiments, the control modules may be located in the bottom rail, or a combination of the head rail and bottom rail. It may also be desired to exclude the head rail and secure the control modules directly to a window frame.

The foregoing descriptions are to be taken as illustrative, but not limiting. Still other variants within the spirit and scope of the present invention will readily present themselves to those skilled in the art.

What is claimed is:

1. A suspension system for a window covering, comprising:

a head rail defining a longitudinal axis;

a weighted element;

a suspension cord having an end connected to the weighted element;

a rotary axle disposed within the head rail and defining a longitudinal axis, the longitudinal axis of the axle and the longitudinal axis of the head rail being substantially parallel; and at least one control module coaxially mounted about the axle and operatively connected with the suspension cord, the control module including:

a rotary drum including a spindle formed coaxially and integrally therewith, the rotary drum configured to wind the suspension cord and the axle is assembled through the drum and spindle;

a stationary support structure also mounted with the axle and disposed within the head rail;

a constant force spring having a first end and a second end, the first end of the spring operatively connected with the spindle of the rotary drum, the second end of the spring being operatively connected to the support structure, the spring being configured to exert a rotational force on the drum causing a raising force opposite to the effective weight of the weighted element wherein the raising force and the effective weight of the weighted element are in substantial equilibrium, the rotational force adapted to be substantially the same amount of force while the window covering is at a raised position and at a lowered position; and each of the rotary drum, the spring, and the support structure being in a coaxial relationship with the axle.

2. The suspension system of claim 1, wherein the suspension cord is guided through and contacts a reaction member which provides a reaction force on the suspension member.

3. The suspension system of claim 2, wherein the reaction member is placed at a position along the suspension cord located downstream from the drum.

4. The suspension system of claim 3, further including a clutch mechanism operatively connected with the suspension cord.

5. A suspension system for a window covering, the suspension system comprising:

a head rail defining a longitudinal axis;

a rotary axle disposed along the longitudinal axis;

the window covering;

at least one control module positioned in the channel and coaxial with the longitudinal axis, the control module comprising:

a stationary support structure also mounted with the axle and disposed within the head rail;

a rotary winding drum and a constant force spring supported by the support structure, the rotary winding drum including a coaxial spindle formed integrally therewith, the constant force spring being configured to exert a rotational force on the drum, the rotational force adapted to be substantially the same amount of force while the window covering is at a raised position and at a lowered position; and wherein the winding drum and spring are in a coaxial relationship and positioned about the rotary axle;

a friction member offset from the winding drum;

a suspension cord having a first end operatively connected to the control module, the suspension cord being wound around the rotary drum and in slidable engagement with the friction member; and a weight of the window covering being in substantial equilibrium with a raising force of the winding drum and a friction force of the friction member.

6. The suspension system of claim 5, wherein the friction member comprises a hook.

7. The suspension system of claim 5, wherein the friction member is positioned along the suspension cord and downstream of the winding drum.

8. The suspension system of claim 5, wherein the friction member includes a plurality of turns between the winding drum and the window covering along which the suspension cord travels.

9. The suspension system of claim 8, wherein the friction member includes three turns.

10. The suspension system of claim 5, wherein the friction member comprises a plurality of surfaces offset from one another.

11. The suspension system of claim 5, further comprising a rotary spindle operatively connected to the winding drum and a first end of the spring.

12. The suspension system of claim 5 comprising a plurality of control modules, wherein each of the control modules are positioned about the axle.

13. The suspension system of claim 5, wherein the spring is a constant force flat spiral spring having a first end and a second end, the first end of the spring operatively connected with the rotary winding drum, the second end of the spring being operatively connected to the support structure, the spring being configured to exert a rotational force on the winding drum.

14. The suspension system of claim 5, wherein the suspension cord is operatively connected at a second end to a window cover member.

15. The suspension system of claim 14, wherein the window cover member comprises a weighted element and window cover material, and the suspension cord is operatively connected to the weighted element.

16. The suspension system of claim 5, further including a clutch mechanism operatively connected with the axle.

17. The suspension system of claim 16, where in the clutch mechanism is configured to releasably lock a weighted element in a desired position, and such that the clutch mechanism is configured to unlock by pulling downward on the weighted element.

18. A window covering comprising:

a head rail;

a bottom weighted element;

a window cover material extending at least partially between the head rail and the bottom weighted element and operatively connected to the bottom weighted element;

a suspension cord having an end connected to the bottom weighted element;

a plurality of control modules mounted on an axle disposed in a longitudinal direction within the head rail, wherein at least one of the control modules includes a rotatable winding drum including a coaxial spindle formed integrally therewith, the winding drum being operatively connected to and coaxial with a constant force spring, the suspension cord partially wound around the winding drum, and the spring operatively connected to and supplying a rotational force to the winding drum, the rotational force being translated by the winding drum to an upward force on a portion of the suspension cord as the window covering is moved between :a lowered position and a raised position, spring being configured to exert a rotational force on the drum causing a raising force opposite to the effective weight of the weighted element wherein the raising force and the effective weight of the weighted element are in substantial equilibrium, the rotational force adapted to be substantially the same amount of force while the window covering is at the raised position and at the lowered position;

the suspension cord, window cover material, and bottom weighted element exerting a weight on the suspension cord;

a window cover material spring force exerting an upward force on the bottom weighted element when the window covering is in the lowered position; and a friction member associated with the cord to provide a static friction force to the cord, the static friction force sufficient to offset a difference between the weight and the sum of the window cover material spring force and the spring upward force when the window covering is stationary.

19. The window covering of claim 18, wherein the friction member comprises a hook.

20. The window covering of claim 19, wherein the hook is positioned such that a suspension cord path includes three turns.

21. The window covering of claim 18, wherein the friction member includes a plurality of surfaces offset from one another.

22. The window covering of claim 18 further comprising a stationary support structure also mounted with the axle and disposed within the head rail, wherein the winding drum and the spring are coaxial with one another, the spring having a first, end and a second end, the first end of the spring operatively connected with the rotary drum and the second end being operatively connected to the support structure.

23. The window covering of claim 18, further comprising a rotary spindle operatively connected to the winding drum and a first end of the spring.

24. The window covering of claim 18, wherein a user-supplied upward force on the window cover member and the upward force on the suspension cord exceed the static friction force.

25. A suspension system in a window covering for controlling the position of a window cover member, the suspension system comprising:

at least one control module and a suspension cord;

the control module defining a stationary support structure for supporting a rotary winding drum including an integrally formed spindle and a constant force spring, the control module further including a friction member configured to supply a static friction force to the suspension cord;

the spring and winding drum being operatively connected to one another such that a rotational force by the spring is exerted on the winding drum, the support structure, spring and winding drum being mounted in a coaxial relationship about an axle and the spring having a first end and a second end, the first end of the spring operatively connected with the rotary drum and the second end being operatively connected to the support structure, the rotational force adapted to be substantially the same amount of force while the window covering is at a raised position and at a lowered position;

the winding drum being operatively connected to a first end of the suspension cord such, that a rotational force of the spring translates to an upward force on a portion of the suspension cord;

the window cover member operatively connected to a second end of the suspension member such that a weight of the window cover member exerts a downward force on the suspension cord;

whereby a difference between the upward force and the downward force are less than the static friction force when the window cover is stationary.

26. The suspension system of claim 25, wherein the static friction force supplied by the friction member is greater when the window covering is in a raised position than when the window covering is in a lowered position.

27. The suspension system of claim 26, wherein the friction member is a hook and the suspension cord has a path including at least three turns.

* * * * *

UNITED STATES PATENT AND TRADEMARK OFFICE

CERTIFICATE OF CORRECTION

PATENT NO. : 7,975,748 B2
APPLICATION NO. : 11/591718
DATED : July 12, 2011
INVENTOR(S) : Fu-Lai Yu et al.

It is certified that error appears in the above-identified patent and that said Letters Patent is hereby corrected as shown below:

IN THE SPECIFICATION:

Column 2, line 56, delete “unshaped” and insert --u-shaped--

CLAIMS:

Column 10, line 37 (Claim 22) after “first” delete --,--

Column 11, line 2 (Claim 25) after “such” delete --,--

Signed and Sealed this
Fourth Day of October, 2011

David J. Kappos

David J. Kappos
*Director of the United States Patent and Trademark Office*